United States Patent [19]

Nakahama et al.

[11] Patent Number: 4,575,342

[45] Date of Patent: Mar. 11, 1986

[54] TILT LOCK MECHANISM FOR MARINE PROPULSION DEVICE

[75] Inventors: Ryoji Nakahama, Iwata; Takashi Iwashita, Hamakita, both of Japan

[73] Assignee: Sanshin Kogyo Kabushiki Kaisha, Japan

[21] Appl. No.: 565,271

[22] Filed: Dec. 27, 1983

[30] Foreign Application Priority Data

Dec. 28, 1982 [JP] Japan ..... 57-227559

[51] Int. Cl.[4] ..... B63H 5/12; B63H 21/26

[52] U.S. Cl. ..... 440/56; 188/318

[58] Field of Search ..... 440/55, 56, 61; 188/300, 314, 318; 267/64.12

[56] References Cited

U.S. PATENT DOCUMENTS

| | | | |
|---|---|---|---|
| Re. 27,932 | 2/1974 | Mettetal | 115/41 HT |
| 3,186,375 | 6/1965 | Cass | 115/41 |
| 3,285,221 | 11/1966 | North | 440/61 |
| 3,434,448 | 3/1969 | Woodfill | 440/61 |
| 3,434,450 | 3/1969 | McCormick | 115/41 |
| 3,722,455 | 2/1973 | Carpenter | 115/41 HT |
| 3,799,104 | 3/1974 | Kurling | 440/61 |
| 3,839,986 | 10/1974 | Meyer | 115/41 HT |
| 3,863,592 | 2/1975 | Borst | 115/17 |
| 3,885,517 | 5/1975 | Borst et al. | 440/61 |
| 3,888,203 | 6/1975 | Lohse | 115/41 HT |
| 3,983,835 | 10/1976 | Hall | 115/41 HT |
| 3,999,502 | 12/1976 | Mayer | 115/41 HT |
| 4,052,952 | 10/1977 | Hale | 115/41 HT |
| 4,064,824 | 12/1977 | Hall | 115/41 HT |

FOREIGN PATENT DOCUMENTS

| | | | |
|---|---|---|---|
| 0095295 | 6/1982 | Japan | 440/61 |

*Primary Examiner*—Sherman D. Basinger

*Attorney, Agent, or Firm*—Ernest A. Beutler

[57] ABSTRACT

A tilt locking and shock absorbing arrangement for a marine outboard drive embodying a single cylinder and piston assembly for controlling the tilt and trim positions of the drive and for further absorbing shocks applied to it. An accumulator arrangement is provided having gas over oil and is valved into the system in such a way as to prevent passage of the gas into the shock absorbing device per se. In addition, an arrangement is provided whereby the drive may be manually positioned without necessitating the operator's use of one hand to operate the mechanism when the desired position is reached.

30 Claims, 6 Drawing Figures

Fig-1
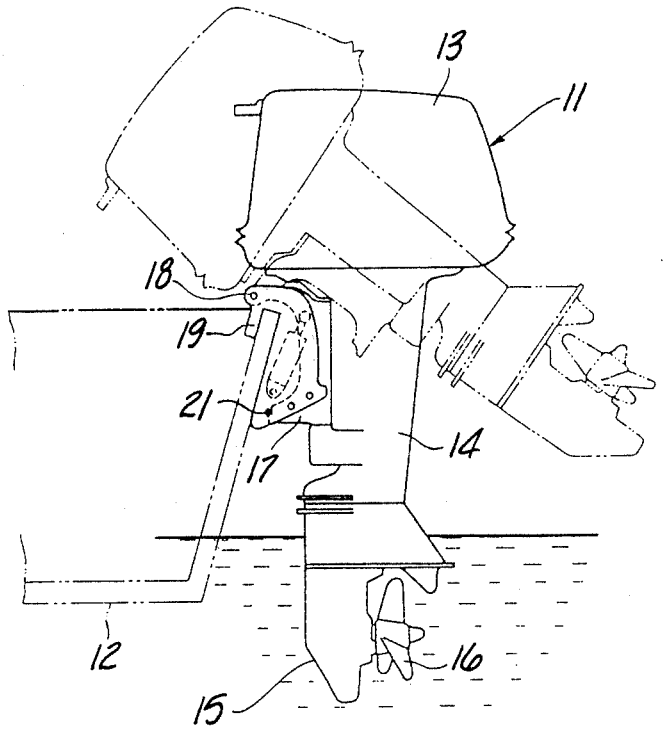
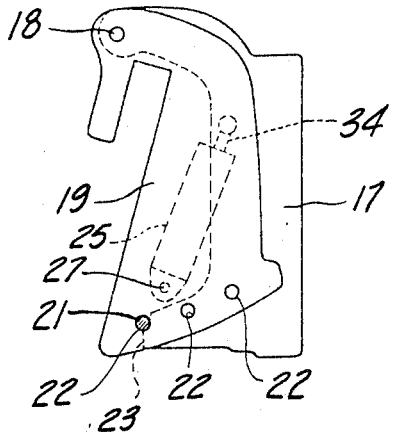
Fig-2

TILT LOCK MECHANISM FOR MARINE PROPULSION DEVICE

BACKGROUND OF THE INVENTION

This invention relates to a tilt locking mechanism for marine propulsion devices and more particularly to an improved simplified tilt locking mechanism that permits the motor to be preset in a plurality of desired trim positions, which permits the motor to pop up under impact and return to position and also which is simple to operate and has a minimum of controls.

A wide variety of devices have been proposed for permitting the trim adjustment of an outboard drive such as the outboard drive unit of an inboard-outboard or an outboard motor per se. Many of these mechanisms also include a device that holds the outboard drive against popping up under reverse thrusts and which nevertheless permits the motor to pop up when traveling in a forward direction and when striking a submerged obstacle. Many of these systems employ hydraulic piston and cylinder arrangements for controlling the outboard drive position and/or movement. Although such hydraulic systems have a number of advantages, those which permit all of the required conditions to be met tend to be extremely complicated, expensive and cumbersome to operate.

In one of the more commonly used type of arrangements, a hydraulic cylinder and piston assembly is interposed between the outboard drive and the transom and embodies a shock absorbing valving arrangement so as to hold the outboard drive against reverse thrusts and also to permit it to pop up when an underwater obstacle is encountered. With such arrangements, the piston rod extends through one chamber of the hydraulic cylinder piston assembly and an arrangement must be employed to compensate for the changes in volume of the piston rod, depending upon the axial position of the associated piston. It is normally the practice to employ an inert gas acting over the hydraulic fluid so as to provide this compensation. Such arrangements, however, have a tendency to permit the inert gas to enter into the shock absorbing arrangement per se and thus significantly diminish the ability of the unit to resist reverse thrusts and absorb impacts.

It is, therefore, a principal object of this invention to provide an improved tilt locking mechanism for an outboard drive that employs a gas over oil arrangement and in which the gas cannot enter into the shock absorbing system.

It is a further object of this invention to provide a hydraulic shock absorbing assembly for an outboard drive using a gas accumulator to compensate for changes in volume of one of the shock absorbing chambers due to the use of a piston rod and in which the gas is effectively isolated from the shock absorbing arrangement.

In addition to employing a hydraulic shock absorbing arrangement for holding the outboard drive against reverse thrusts and for permitting it to pop up while traveling forwardly and striking a submerged obstacle with sufficient force, the hydraulic arrangements also may include a mechanism for permitting the outboard drive to be tilted up out of the water and held in a tilted up position. Such tilt locking mechanisms normally include a valve passage or passages that permit the chambers of the shock absorbing arrangement to communicate freely with each other without the restriction of the shock absorbing valves. These tilt locking valves are manually operated and normally require the operator to open the valve, manually tilt the motor up and subsequently to close the valve to lock the motor in a tilted up position. Of course, this necessitates the operator to use one hand to operate the valve and leaves only one hand free to manipulate the outboard drive.

It is, therefore, a further object of this invention to provide a simplified mechanism for locking an outboard drive in a tilted up position.

It is yet another object of this invention to provide a manual override for a hydraulic shock absorbing arrangement for an outboard drive that frees the operator's hands for moving the outboard drive to a tilted up position.

SUMMARY OF THE INVENTION

A first feature of this invention is adapted to be embodied in a tilt locking and shock absorbing arrangement for a marine outboard drive comprising a drive member supported for tilting movement relative to a hull of an associated watercraft about a substantially horizontally disposed tilt axis. A hydraulic assembly is incorporated that comprises a cylinder, a piston slidably supported in the cylinder and defining first and second chambers, and a piston rod affixed to the piston and extending through one of the chambers. The hydraulic assembly is operatively interposed between the hull and the drive member for relative movement of the piston and cylinder upon tilting movement of the drive member about the tilt axis. Damping means permits flow from the first chamber to the second chamber upon the application of a predetermined force tending to cause the drive member to tilt up about the tilt axis and for permitting flow from the second chamber to the first chamber upon the exertion of a predetermined force to effect tilt down of the drive member. Means control movement of the drive member about the tilt axis comprising passage means extending between the first and second chambers, first check valve means in the passage means for permitting flow from the first chamber to the second chamber and for precluding flow from the second chamber to the first chamber, second check valve means in the passage means for permitting flow from the second chamber to the first chamber and for precluding flow from the first chamber to the second chamber, and control means for selectively opening one of the check valve means so that the other of the check valve means controls the flow through the passage means. In accordance with this feature of the invention, an accumulator is in communication with the passage means between the check valve means for compensating for the changes in the volume of the fluid displaced by the piston rod from the one chamber.

Another feature of the invention is also adapted to be embodied in a tilt locking and shock absorbing arrangement for a marine outboard drive having a drive member and a hull as described in the preceding paragraph. In accordance with this feature of the invention, the hydraulic assembly comprising a cylinder, a first piston slidably supported in the cylinder and defining first and second chambers and a second piston supported for movement in the cylinder within the second chamber. The hydraulic assembly is interposed between the hull and the drive member for relative movement of the first piston and the cylinder upon tilting movement of the drive member about its tilt axis. Damping means permits flow from the first chamber to the second chamber upon the application of a predetermined force tending to cause the drive member to tilt up about the tilt axis and for permitting flow from the second chamber to the first chamber upon the exertion of a predetermined force to effect tilt down of the drive member. The position of the second piston in the cylinder is effective to control the normal trim position of the drive unit by restricting movement of the first piston relative to the cylinder in one direction. In accordance with this feature of the invention, means including manually releasable valve means permit the second piston to be manually moved within the cylinder upon the application of a predetermined force for manual adjustment of the trim position of the drive unit and means are provided for retaining the second piston in position against the weight of the outboard drive regardless of the condition of the manually releasable valve means.

BRIEF DESCRIPTION OF THE DRAWINGS

FIG. 1 is a side-elevational view of an outboard motor embodying a tilt lock mechanism constructed in accordance with the invention, attached to the transom of an associated watercraft (shown in phantom). The solid line view shows the motor in its normal running condition while phantom line view shows the motor in a tilted up condition.

FIG. 2 is an enlarged side-elevational view of the tilt mechanism and associated tilt lock mechanism.

FIG. 3 shows the popping up under normal running conditions.

FIG. 4 shows the return to the normal running condition from the popped up condition.

FIG. 5 shows operation in a shallow water condition.

FIG. 6 shows popping up from the shallow water condition.

DETAILED DESCRIPTION OF THE PREFERRED EMBODIMENT OF THE INVENTION

Figure 3:
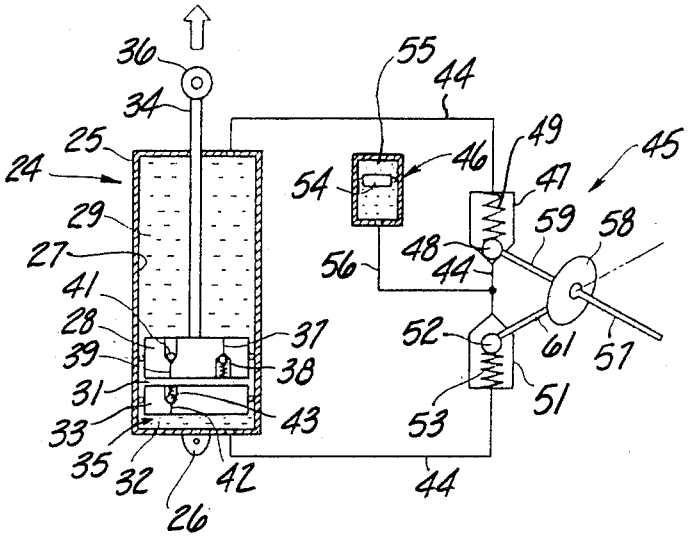
FIGS. 3 through 6 are cross-sectional, partially schematic views of the tilt locking mechanism under various conditions.

Referring first to FIGS. 1 and 2, an outboard motor is identified generally by the reference numeral 11. Except with respect to the tilt locking mechanism, the outboard motor 11 and its association with a watercraft, shown in phantom and identified by the reference numeral 12, is generally conventional. The outboard motor 11 includes a power head 13 in which an internal combustion engine of a known type is supported. The engine, which is not shown, has an output shaft that drives a drive shaft (not shown) that extends through and is journaled in a drive shaft housing 14 and which terminates at a forward-reverse transmission located in a lower unit 15. The transmission, in turn, drives a propeller 16.

The drive shaft housing 14 carries a steering shaft that is journaled for steering movement about a generally vertically extending axis by means of a swivel bracket 17. The swivel bracket 17 is, in turn, supported for pivotal movement about a generally horizontally extending axis by means of a pivot pin 18 which is, in turn, affixed to a clamping bracket 19. The clamping bracket is, in turn, affixed in a known manner to the hull of the watercraft 12.

A trim pin 21 is received in selective pairs of aligned apertures 22 formed in the clamping bracket 19. The swivel bracket 17 has a forwardly extending edge 23 that is adapted to engage the trim pin 21 so as to determine the normal trim condition of the motor 11 about the pivot pin 18.

A combined tilt locking and shock absorbing assembly, indicated generally by the reference numeral 24 and shown in most detail in FIGS. 3 through 6, is incorporated for controlling the position of the motor 11, as will become apparent. Referring now to these additional figures, the mechanism 24 includes a cylinder assembly 25 carrying an integral trunnion 26 at its lower end. The trunnion 26 affords a means by which a pivot pin 27 can pivotally connect the assembly 24 to the clamping bracket 19 in a suitable manner.

The cylinder 25 has a cylinder bore 27 in which a first piston 28 is supported for reciprocation. The piston 28 divides the cylinder bore 27 into an upper chamber 29 and a lower chamber which is, in turn, divided into an upper portion 31 and a lower portion 32 by means of a floating piston 33 that is slidably supported in the bore 27. A piston rod 34 is affixed to the piston 28 and extends through the chamber 29. A suitable seal (not shown) surrounds the upper end of the piston rod 34 so as to prevent leakage of a hydraulic fluid 35 that is contained within the chambers 29 and the lower chamber portions 31 and 32.

The exposed end of the piston rod 34 is formed with a clevis 36 to afford a connection to a pivot pin to provide a pivotal connection to the swivel bracket 17.

A first absorber passage 37 extends through the piston 28 so as to permit flow from the chamber 29 to the upper portion 31 of the lower chamber. A pressure-responsive one-way absorber valve 38 is provided in the passage 37 so as to permit flow from the chamber 29 to the lower portion 31 while precluding flow in the opposite direction.

A relief passage 39 also extends through the piston 28 so as to communicate the chamber 29 with the lower chamber upper portion 31. A check valve 41 is provided in the passage 39 so as to permit flow from the lower portion 31 to the chamber 29 while precluding reverse flow. The valve 41 opens at a significantly lower pressure than the valve 38. The weight of the motor 11 is sufficient so as to cause the valve 41 to open, as will become apparent.

A passage 42 extends through the piston 33 between the lower chamber parts 31 and 32. A pressure-responsive check valve 43 is positioned in this passage so as to permit flow only from the part 32 to the part 31 while precluding any reverse flow.

A bypass passage 44 extends from the upper portion of the upper chamber 29 to a position at the lower end of the lower chamber part 32. A manually operated control valve assembly, indicated generally by the reference numeral 45, is provided so as to control the flow through the passage 44 so as to permit manual adjustment in the angle of the outboard motor 11 relative to the clamping bracket 19 about the pivot pin 18. In addition, an accumulator chamber, indicated generally by the reference numeral 46, communicates with the passageway 44 in a manner to be described so as to compensate for changes in the volume of the fluid in the chamber 29 displaced by the piston rod 34 without causing gases to enter into the assembly 24.

The manually operated control valve assembly 45 includes a first check valve 47 having a ball-type valve element 48 that is urged by a spring 49 to a closed position that precludes communication from the chamber 29 to the lower chamber part 32. However, upon the exertion of sufficient pressure difference, the ball valve 48 can open so as to permit flow from the lower chamber part 32 to the chamber 29, as will become apparent.

The control valve assembly 45 includes a second check valve assembly 51 having a ball-type check valve 52 that is urged by a coil compression spring 53 toward a closed position wherein flow between the chamber 29 and lower chamber part 32 is precluded. Fluid pressure can unseat the ball 52 under certain circumstances, as will be described, so as to permit flow from the chamber 29 into the lower chamber part 32.

The accumulator 46 includes a floating piston 54 that is pressurized on its upper side by an inert gas 55 such as nitrogen. The underside of the piston 54 is urged against the hydraulic fluid which fills the chamber 29 and chamber parts 32 and 33. This hydraulic fluid may communicate from the accumulator 46 with the area in the passage 44 between the two check valve assemblies 47 and 51 through a passageway 56.

The valve assembly 45 also includes a manual operator having a manually operable lever 57 that operates a cam 58 which, in turn, operates a pair of push rods 59 and 61 so as to selectively hold the respective balls 48, 52, of the check valve assemblies 47 and 51 in their opened positions.

Figure 4:
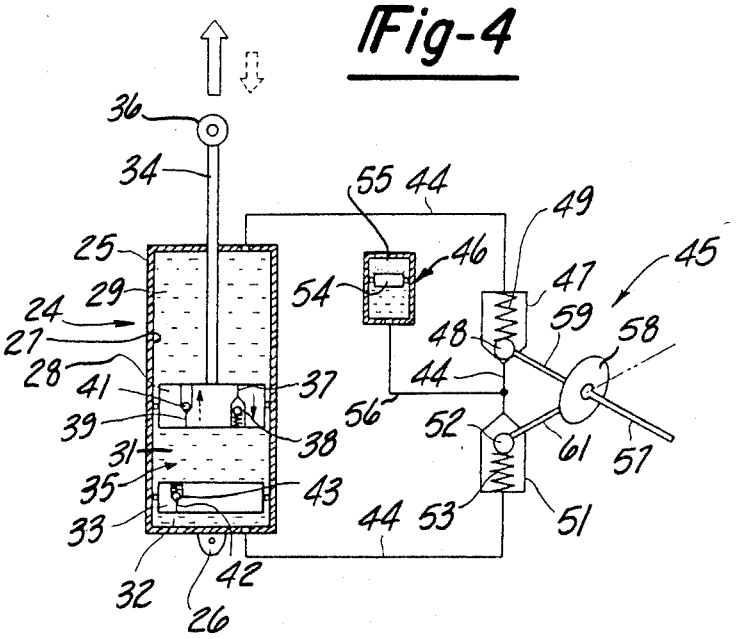

FIGS. 3 and 4 show the valve assembly 45 as it appears when set manually for normal running condition. In this condition, the lever 57 is positioned so that the push rod 59 will permit the ball 48 of the check valve 47 to be retained in its closed position by the spring 49. On the other hand, the push rod 61 will engage the ball 52 of the check valve 51 so as to hold the check valve 51 in an opened condition. Thus, the check valve 47 controls the direction of flow and the flow conditions through the passage 44.

The position of the floating piston 33 will determine the at rest position of the piston 28 and, accordingly, the trim angle of the motor 11 about the pivot pin 18. The valve 43 in the floating piston 33 has sufficient force required to open it so as to resist the weight of the motor 11 and hold it in the adjusted trim condition.

When operating in the reverse mode, the motor 11 tends to tilt up about the pivot pin 18. This movement causes a force to be exerted on the piston rod 34 which tends to cause it and the piston 28 to be drawn upwardly. However, the setting of the absorber valve 38 is such that these normal reverse thrust forces are resisted and the motor 11 will be held against popping up under reverse drive condition.

When operating in a forward direction and if an underwater obstacle is struck by the lower unit 15 with sufficient force, the piston rod 34 will exert sufficient force on the piston 28 so as to overcome the action of the absorber valve 38 and permit the piston 28 to move upwardly and the motor 11 to pop up. The absorber valve 38 will, however, offer some resistance to this movement. Fluid cannot flow from the chamber 29 through the passage 44 since the increase in pressure in the chamber 29 will hold the check valve assembly 47 and more particularly its ball 48 in the closed position. When the struck underwater obstacle provides sufficient force, the piston 28 will move upwardly and fluid will flow through the absorber valve 38 from the chamber 29 to the lower chamber part 31 above the floating piston 33. Because less of the piston rod 34 is immersed in the chamber 29, it will be necessary to add further fluid to the area below the piston 28 so as to accommodate for these volume changes. This fluid will be supplied from the accumulator 44 through the passage 58 and open check valve 51 to the area beneath the floating piston 33. Thus, the floating piston 33 will also move up slightly when the motor 11 pops up as shown in FIG. 4.

Once the underwater obstacle has been cleared, the weight of the motor 11 acting on the piston rod 34 and piston 28 will cause the return valve 41 to open and permit hydraulic fluid to flow back to the chamber 29 from the lower chamber part 31 through the return passage 39. As the motor lowers, as shown in the broken arrow in FIG. 4, the floating piston 25 will again move downwardly so as to displace fluid back to the accumulator 46 through the open check valve 51 so as to again compensate for the variation in volume displaced in the chamber 29 by the piston rod 34. Once the motor reaches the preset trim position, the downward movement will discontinue. During the downward movement, there is insufficient pressure generated on the underside of the floating piston 33 so as to cause the check valve 47 to open. Hence, no fluid will be returned to the chamber 29 through the passageway 44.

Figure 5:
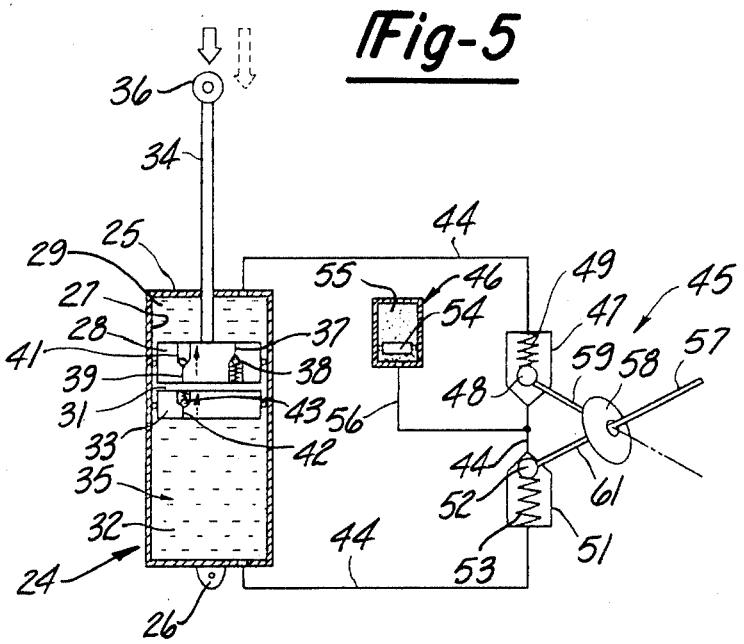
Figure 6:
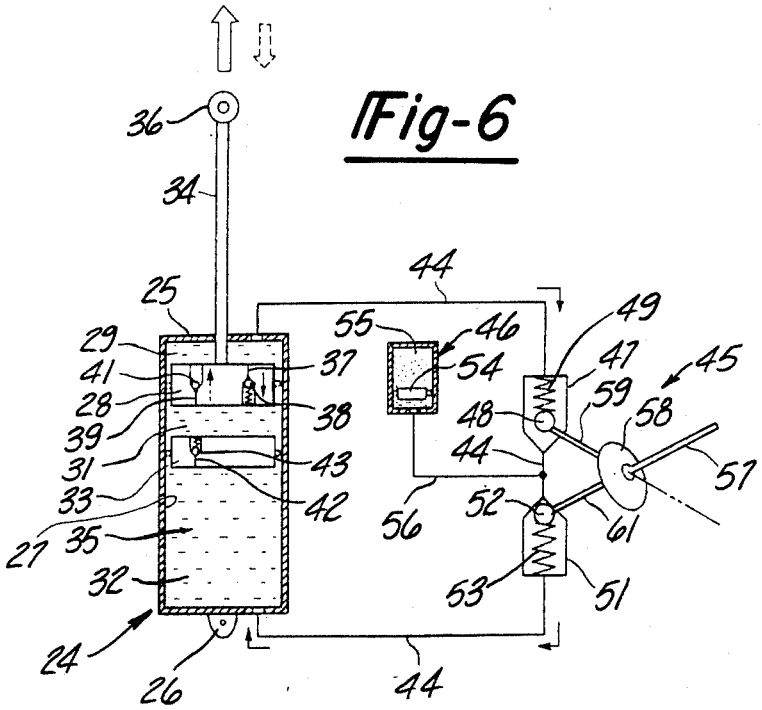

If it is desired to manually change the trim position of the motor 11 so as to either set the motor 11 for a shallow water running condition or so as to tilt it up out of the water, the manually operated valve 45 is moved from its normal position, as shown in FIGS. 3 and 4, to its trim adjusting position, as shown in FIGS. 5 and 6. This causes the ball 48 of the check valve assembly 47 to be unseated and, at the same time, permit seating of the ball 52 of the check valve assembly 51. In this condition, fluid may flow between the chamber 29 and the lower part 32 through the passageway 44 under the control of the check valve assembly 51. That is, fluid may flow from the chamber 29 to the lower chamber part 32 if sufficient force is exerted so as to unseat the ball 52 of the check valve assembly 51. Flow in the opposite direction is, however, prevented.

When the manually operated valve 45 is set in the trim adjusting position, the trim of the motor 11 may be adjusted by the operator exerting a force on the motor 11 tending to rotate it in a counterclockwise direction about the pivot pin 18. This causes the piston rod 34 and piston 28 to move upwardly in the cylinder bore 27. Upon such upward movement, the fluid from the chamber 29 will be urged into the line 44 and will act upon the check valve 51 so as to unseat the ball 52 and permit the fluid to flow to the lower chamber part 32. This flow of fluid causes the floating piston 33 to follow the piston 28 in an upward direction until the desired trim angle is reached. The accumulator 46 will again cause fluid to enter the system so as to compensate for changes in volume displaced by the piston rod 34 in the chamber 29. When the desired trim position is reached, the operator need merely reduce or release the force he has applied on the motor 11. Thus, a downward force will be exerted upon the piston rod 34 which tends to cause the piston 28 to move downwardly in the bore 27. The piston 28 will, however, engage the piston 33 and any force tending to cause it to move downwardly will be resisted by the pressure necessitated to open the check valve 43 in the piston 33. This is greater than the force of the weight of the motor and, accordingly, the motor will be held in the tilted up condition.

Assuming that the motor has not been tilted up out of the water, but has only been tilted to a shallow trim condition, the device 24 will function so as to permit the motor to pop up when an underwater obstacle is struck when traveling in a forward direction and, also, will function to prevent the motor 11 from popping up under reverse thrusts much the same as in conjunction with the description of FIGS. 3 and 4. Since the operation under these modes is believed to be readily apparent, it will not be described again in detail. However, FIG. 6 does show the condition when the motor 11 has popped up. Under this condition, fluid will flow through the absorber valve 38 from the chamber 29 to the lower chamber part 31. Again, the accumulator 46 will act so as to compensate for changes in volume displaced by the piston rod 34 in the chamber 29. Fluid may also flow from the chamber 29 to the lower chamber part 32 through opening of the check valve if sufficient force is encountered. When the underwater obstacle is cleared, the motor 11 will again return to the trim adjusted position. However, it will be at a slightly higher level due to the displacement of fluid through the passage 44 to the underside of the floating piston 33. The floating piston 33 will be held in a slightly elevated position under this return condition.

It should be noted that all of this operation may be accomplished with the manually operated valve 45 still held in the trim adjusted position. In this condition, if it is desired to tilt the motor back down to a lower trim adjusting condition, a very high forward thrust may be exerted by accelerating the motor 11. This high force, is indicated by the broken line arrow in FIG. 5, will cause the piston 28 to exert sufficient force on the piston 33 so as to cause the check valve 43 in the floating piston 33 to open and, accordingly, open the valve 41 in the piston 28 so that the pistons 28 and 33 can move downwardly together.

It should be readily apparent from the foregoing description that a relatively simple arrangement has been provided wherein an accumulator chamber communicates with the shock abosrbing mechanism in such a way that the gas which acts to compensate for the changes in volume displaced by the piston rod 34 cannot enter the shock absorbing mechanism. This is achieved through the unique placement of the communication of the accumulator 34 with the control valve 45 between the two check valves 47 and 51. Also, the arrangement is such that the trim condition of the motor can be adjusted without necessitating an operator using one hand to move the motor and another hand to operate the control lever 57.

Although a preferred embodiment of the invention has been illustrated and described, it is believed to be readily apparent that various changes and modifications may be made, without departing from the spirit and scope of the invention as defined by the appended claims.

We claim:

1. In a tilt locking and shock absorbing arrangement for a marine outboard drive comprising a drive member supported for tilting movement relative to a hull of an associated watercraft about a substantially horizontally disposed tilt axis, a hydraulic assembly comprising a cylinder and a piston slidably supported in said cylinder and defining first and second chambers, a piston rod affixed to said piston and extending through one of said chambers, means for operatively interposing said hydraulic assembly between said hull and said drive member for relative movement of said piston and said cylinder upon tilting movement of said drive member about said tilt axis, damping means for permitting flow from said first chamber to said second chamber upon the application of a predetermined force tending to cause said drive member to tilt up about said tilt axis and for permitting flow from said second chamber to said first chamber upon the exertion of a predetermined force to effect tilt down of said drive member, means for controlling movement of said drive member about said tilt axis comprising passage means extending between said first and second chambers, first check valve means in said passage means for permitting flow from said first chamber to said second chamber and for precluding flow from said second chamber to said first chamber, second check valve means in said passage means for permitting flow from said second chamber to said first chamber and for precluding flow from said first chamber to said second chamber, and control means for selectively opening one of said check valve means so that the other of said check valve means controls the flow through said passage means, the improvement comprising an accumulator communicating with said passage means between said check valve means for compensating for the changes in the volume of the fluid displace from said one chamber by said piston rod.

2. In a tilt locking and shock absorbing arrangement as set forth in claim 1 wherein the control means includes a single manually operable means for selectively opening each of the check valve means.

3. In a tilt locking and shock absorbing arrangement as set forth in claim 2 further including a second piston slidably supported in said cylinder on the side opposite said piston rod and adapted to engage the first-mentioned piston for fixing the trim position of the drive member.

4. In a tilt locking and shock absorbing arrangement as set forth in claim 2 wherein the single manually operable means is operative to maintain a selected one of the check valve means in its open position and for permitting normal check valve operation of the other of the check valve means.

5. In a tilt locking and shock absorbing arrangement as set forth in claim 4 further including a second piston slidably supported in said cylinder on the side opposite said piston rod and adapted to engage the first-mentioned piston for fixing the trim position of the drive member.

6. In a tilt locking and shock absorbing arrangement as set forth in claim 5 wherein the accumulator comprises a chamber containing fluid with gas under pressure above said fluid.

7. In a tilt locking and shock absorbing arrangement as set forth in claim 6 further including a floating piston within said accumulator and separating the fluid and pressurized gas.

8. In a tilt locking and shock absorbing arrangement as set forth in claim 1 wherein the control means is movable between a first position wherein one of the check valve means is held in an opened condition and the other of the check valve means is permitted to function normally and a second position wherein the other of the check valve means is held in an opened position and the one of the check valve means is operative to perform its normal check valve function.

9. In a tilt locking and shock absorbing arrangement as set forth in claim 8 further including a second piston slidably supported in said cylinder on the side opposite said piston rod and adapted to engage the first-mentioned piston for fixing the trim position of the drive member.

10. In a tilt locking and shock absorbing arrangement as set forth in claim 9 wherein there is a check valve passage extending through the second piston for permitting flow in one direction therethrough while precluding flow in the opposite direction.

11. In a tilt locking and shock absorbing arrangement as set forth in claim 1 wherein the damping means comprises a first passage including pressure responsive absorber valve means for permitting flow from said first chamber to said second chamber upon the application of a predetermined force tending to cause said drive member to tilt up about said tilt axis, and a second passage including pressure responsive relief valve means for permitting flow from said second chamber to said first chamber upon the exertion of a predetermined force to effect tilt down of said drive member.

12. In a tilt locking and shock absorbing arrangement as set forth in claim 11 wherein the control means includes a single manually operable means for selectively opening each of the check valve means.

13. In a tilt locking and shock absorbing arrangement as set forth in claim 12 further including a second piston slidably supported in said cylinder on the side opposite said piston rod and adapted to engage the first-mentioned piston for fixing the trim position of the drive member.

14. In a tilt locking and shock absorbing arrangement as set forth in claim 11 wherein there is a check valve passage extending through the second piston for permitting flow in one direction therethrough while precluding flow in the opposite direction.

15. In a tilt locking and shock absorbing arrangement as set forth in claim 12 wherein the single manually operable means is operative to maintain a selected one of the check valve means in its open position and for permitting normal check valve operation of the other of the check valve means.

16. In a tilt locking and shock absorbing arrangement as set forth in claim 15 further including a second piston slidaly supported in said cylinder on the side opposite said piston rod and adapted to engage the first-mentioned piston for fixing the trim position of the drive member.

17. In a tilt locking and shock absorbing arrangement as set forth in claim 16 wherein the accumulator comprises a chamber containing fluid with gas under pressure above said fluid.

18. In a tilt locking and shock absorbing arrangement as set forth in claim 17 further including a floating piston within said accumulator and separating the fluid and pressurized gas.

19. In a tilt locking and shock absorbing arrangement as set forth in claim 11 wherein the accumulator comprises a chamber containing fluid with gas under pressure above said fluid.

20. In a tilt locking and shock absorbing arrangement as set forth in claim 19 further including a floating piston within said accumulator and separating the fluid and pressurized gas.

21. In a tilt locking and shock absorbing arrangement as set forth in claim 11 wherein the control means is movable between a first position wherein one of the check valve means is held in an opened condition and the other of the check valve means is permitted to function normally and a second position wherein the other of the check valve means is held in an opened position and the one of the check valve means is operative to perform its normal check valve function.

22. In a tilt locking and shock absorbing arrangement as set forth in claim 21 wherein the control means includes a single manually operable means for selectively opening each of the check valve means.

23. In a tilt locking and shock absorbing arrangement as set forth in claim 21 wherein the accumulator comprises a chamber containing fluid with gas pressure above said fluid.

24. In a tilt locking and shock absorbing arrangement as set forth in claim 23 further including a floating piston within said accumulator and separating the fluid and pressurized gas.

25. In a tilt locking and shock absorbing arrangement as set forth in claim 1 wherein the accumulator comprises a chamber containing fluid with gas under pressure above said fluid.

26. In a tilt locking and shock absorbing arrangement as set forth in claim 25 further including a floating piston within said accumulator and separating the fluid and pressurized gas.

27. In a tilt locking and shock absorbing arrangement for a marine outboard drive comprising a drive member supported for tilting movement relative to a hull of an associated watercraft about a substantially horizontally disposed tilt axis, a hydraulic assembly comprising a cylinder and a first piston slidably supported in said cylinder and defining first and second chambers, means for operatively interposing said hydraulic assembly between said hull and said drive member for relative movement of said first piston and said cylinder upon tilting movement of said drive member about said tilt axis, damping means for permitting flow from said first chamber to said second chamber upon the application of a predetermined force tending to cause said drive member to tilt up about said tilt axis and for permitting flow from said second chamber to said first chamber upon the exertion of a predetermined force to effect tilt down of said drive member, and a second piston supported for movement in said cylinder within said second chamber, the position of said second piston being effective to control the normal trim position of the drive unit by restricting the movement of said first piston relative to said cylinder in one direction, the improvement comprising means including manually releasable valve means for permitting said second piston to be manually moved within said cylinder upon the application of a predetermined force for manual adjustment of the trim position of said drive unit and means comprising check valve means for precluding flow from the second chamber below the second piston to the first chamber until a predetermined force is exerted upon the second piston for retaining said second piston in position against the weight of said outboard drive regardless of the condition of said manually operated valve means.

28. In a tilt locking and shock absorbing arrangement as set forth in claim 27 wherein the means for retaining the second piston in position is effective to prevent movement of the second piston in either direction from the trim position regardless of the condition of the manually operated valve means.

29. In a tilt locking and shock absorbing arrangement as set forth in claim 28 wherein the manually releasable valve means comprises a pair of oppositely acting check valve means, each of which is operative to preclude flow between the first chamber and the portion of the second chamber beneath the second piston until a predetermined force is exerted.

30. In a tilt locking and shock absorbing arrangement as set forth in claim 29 further including manually operable means for selectively opening said check valve means.

* * * * *

UNITED STATES PATENT AND TRADEMARK OFFICE

CERTIFICATE OF CORRECTION

PATENT NO. : 4,575,342

DATED : March 11, 1986

INVENTOR(S) : Ryoji Nakahama et al

It is certified that error appears in the above-identified patent and that said Letters Patent is hereby corrected as shown below:

Column 7, line 37, "abosrbing" should be --absorbing--.

Column 8, line 21, Claim 1 "displace" should be --displaced--.

Column 9, line 27, Claim 14, "11" should be --13--.

Column 9, line 39, Claim 16, "slidaly" should be --slidably--.

Column 10, line 5, Claim 23, following "gas" insert --under--.

Signed and Sealed this

Seventh Day of October, 1986

[SEAL]

*Attest:*

DONALD J. QUIGG

*Attesting Officer*

*Commissioner of Patents and Trademarks*